US011371377B2

(12) United States Patent
Chohan et al.

(10) Patent No.: US 11,371,377 B2
(45) Date of Patent: Jun. 28, 2022

(54) GAS TURBINE INDUCTION SYSTEM, CORRESPONDING INDUCTION HEATER AND METHOD FOR INDUCTIVELY HEATING A COMPONENT

(71) Applicant: Siemens Energy Global GmbH & Co. KG, Munich (DE)

(72) Inventors: Harry Chohan, Pointe-Claire (CA); Sébastien Bouffard, Verdun (CA); Alexandre Malo, Vaudreuil-Dorion (CA); Hayden Smith, Saint-Laurent (CA)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 57 days.

(21) Appl. No.: 16/771,714

(22) PCT Filed: Jan. 5, 2018

(86) PCT No.: PCT/US2018/012514
§ 371 (c)(1),
(2) Date: Jun. 11, 2020

(87) PCT Pub. No.: WO2019/135758
PCT Pub. Date: Jul. 11, 2019

(65) Prior Publication Data
US 2020/0400035 A1 Dec. 24, 2020

(51) Int. Cl.
*F01D 25/12* (2006.01)
*F01D 11/24* (2006.01)
*F01D 25/10* (2006.01)

(52) U.S. Cl.
CPC ..... *F01D 11/24* (2013.01); *F01D 25/12* (2013.01); *F01D 25/10* (2013.01); *F05D 2260/201* (2013.01); *F05D 2270/303* (2013.01)

(58) Field of Classification Search
None
See application file for complete search history.

(56) References Cited

U.S. PATENT DOCUMENTS

| | | | |
|---|---|---|---|
| 5,630,702 A | 5/1997 | Marmilic et al. | |
| 2014/0321984 A1 | 10/2014 | Welch et al. | |
| 2021/0189906 A1* | 6/2021 | Chohan | F01D 25/14 |

FOREIGN PATENT DOCUMENTS

| | | |
|---|---|---|
| EP | 2754859 A1 | 7/2014 |
| FR | 2890685 A1 | 3/2007 |

OTHER PUBLICATIONS

PCT International Search Report and Written Opinion of International Searching Authority dated Aug. 27, 2018 corresponding to PCT International Application No. PCT/US2018/012514 filed Jan. 5, 2018.

* cited by examiner

*Primary Examiner* — Michael Lebentritt

(57) ABSTRACT

An induction heater is employed with a gas turbine engine in order to heat a static component of the gas turbine engine. The heating of the static component is performed such that the clearance space between the static component and a rotating component remains constant during steady state conditions and transient conditions.

20 Claims, 3 Drawing Sheets

GAS TURBINE INDUCTION SYSTEM, CORRESPONDING INDUCTION HEATER AND METHOD FOR INDUCTIVELY HEATING A COMPONENT

BACKGROUND

1. Field

Disclosed embodiments are generally related to turbine engines, and in particular to applying induction heating to engine components during start up.

2. Description of the Related Art

The performance and operability of gas turbines is dictated in large part by the clearance of the rotating components with respect to the adjacent static sealing surfaces. In the design phase, compromises need to be made with respect to the clearance area so as to optimize steady state performance and transient operability. For instance, when a clearance is minimized while considering only baseload steady-state operation, during transient conditions, the clearance will likely be sub-optimal, thus limiting operability.

FIG. 1 shows a gas turbine engine 100. The gas turbine engine 100 has static components 22 and rotating components 24 that are part of the turbine 20. To prevent contact of static components 22 and rotating components 24 during transient operating conditions, operability limits are put on the overall start-shutdown cycle of the gas turbine engine 100. These operability limits may include modification of acceleration rates and the locking of components.

FIG. 2 illustrates the variation of the clearance between the static components 22 and rotating components 24 during operation of the gas turbine engine 100. During the operation of the gas turbine engine 100 there are steady-state conditions and transient conditions. During the steady-state condition temperatures remain reasonably steady. During transient conditions the temperature is changing at a rapid rate. The steady-state conditions noted in FIG. 2 are start-up, steady-state and shut-down. The transient conditions noted in FIG. 2 are ignition, acceleration, deceleration and cooling.

Still referring to FIG. 2, the clearance, measured in micro-meters is at its greatest during start-up and after shut-down, which are steady state conditions. During ignition, acceleration and steady-state operation the clearance decreases. This is due to the increased temperatures caused by the ignition and start-up of the gas turbine engine. Clearance increases during deceleration, cooling and shut-down. To prevent contact of static and rotating components during transient conditions (i.e. those times when the clearance is changing), operability limits are put on the overall start-shutdown cycle of a gas turbine engine 100. For example, these limits include acceleration rates and lock-out periods after shut-down or failed starts whereby the gas turbine engine 100 cannot be restarted until it cools down as a result of these considerations.

It is preferable to be able to account for the changes in clearance between static components and rotating components in order to improve design and performance of the gas turbine engine.

SUMMARY

Briefly described, aspects of the present disclosure relate to induction heating of gas turbine engine components.

An aspect of the present disclosure may be a system for inductively heating a component of a gas turbine engine. The gas turbine engine may have a longitudinal axis extending lengthwise through the center of the gas turbine engine; an induction heater located proximate to a static component of the gas turbine engine; a rotating component located radially inward from the static component, wherein there is a clearance space between the rotating component and the static component; and wherein the induction heater is adapted to heat the static component so as to maintain substantially the same clearance space between the static component and the rotating component during operation of the gas turbine engine.

Another aspect of the present disclosure may be an induction heater for a gas turbine engine. The induction heater may have a coil adapted to surround a static component of the gas turbine engine, wherein the gas turbine engine has a longitudinal axis extending lengthwise through the center of the gas turbine engine, wherein a rotating component is located radially inward from the static component, wherein there is a clearance space between the rotating component and the static component; and an electric component for transmitting electricity through the coil surrounding the static component, the transmission of electricity heats the static component so as to maintain substantially the same clearance space between the static component and the rotating component during operation of the gas turbine engine.

Still yet another aspect of the present invention may be a method for inductively heating a component of a gas turbine engine. The method may comprise inductively heating a gas turbine component, wherein the gas turbine engine has a longitudinal axis extending lengthwise through the center of the gas turbine engine, wherein the gas turbine engine has a rotating component located radially inward from the static component, wherein there is a clearance space between the rotating component and the static component; and starting and ceasing inductively heating of the static component so as to maintain substantially the same clearance space between the static component and the rotating component during operation of the gas turbine engine.

DETAILED DESCRIPTION

To facilitate an understanding of embodiments, principles, and features of the present disclosure, they are disclosed hereinafter with reference to implementation in illustrative embodiments. Embodiments of the present disclosure, however, are not limited to use in the described systems or methods and may be utilized in other systems and methods as will be understood by those skilled in the art.

The components described hereinafter as making up the various embodiments are intended to be illustrative and not restrictive. Many suitable components that would perform the same or a similar function as the components described herein are intended to be embraced within the scope of embodiments of the present disclosure.

Active thermal control of a gas turbine engine's static components offers additional degrees of flexibility to this equation. Specifically, clearances between the static components and the rotating components can be optimized for either steady-state conditions or transient conditions during the operation of the gas turbine engine 100. In other words, the non-optimal operational conditions and/or design features of the gas turbine engine 100 can be overcome though the use of induction heating. For example, clearances can be reduced and maintained by heating static components via the use of induction heating. It should be understood that while gas turbine engines are referred to herein this may also be applied steam turbine engines and other apparatuses and systems that may benefit from the application of heat to components during operation.

Figure 1:
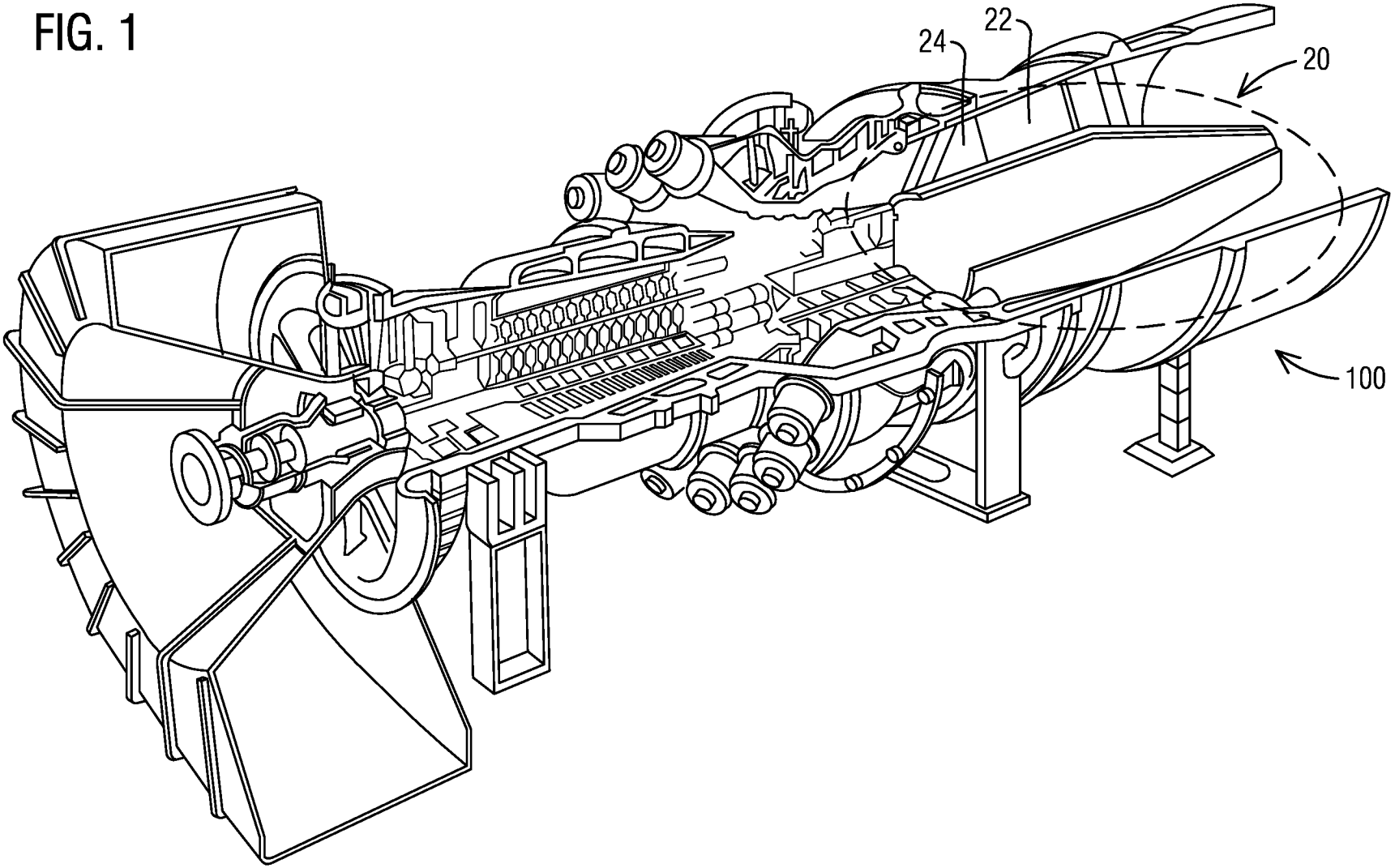
FIG. 1 is a cross-sectional view of a gas turbine engine.
Figure 2:
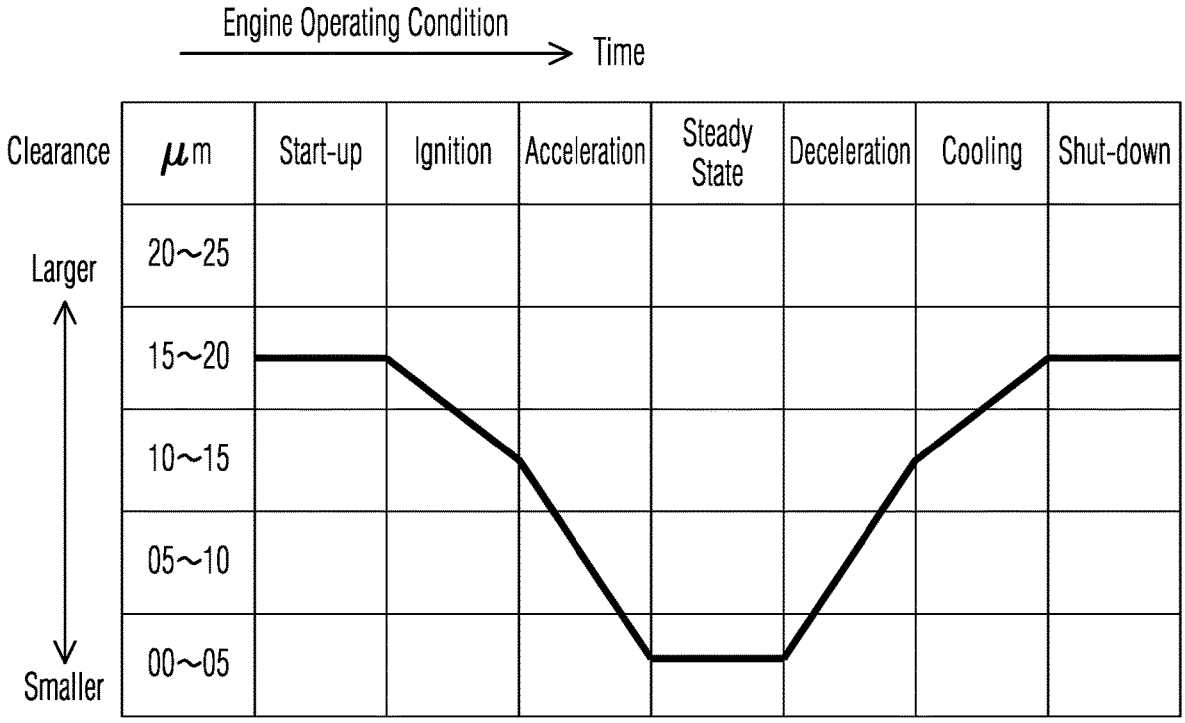
FIG. 2 is graph illustrating the change in clearance within the gas turbine engine between the rotating components and the static components.

Referring to FIG. 1 turbine 20 has a rotating component 24 that is designed for minimal clearance with the static component 24 during baseload operation. During a transient condition, such as a fast acceleration, a rub between static components 22 and rotating components 24 may occur. In order to avoid the rub between static components 22 and rotating components 24 the gas turbine engine 100 can be designed with larger baseload clearances. However a design that has larger baseload clearances is a sub-optimal design. By providing active induction heating on the static components 22 during the acceleration, the rub between the static component 22 and the rotating component 24 can be avoided, and optimal clearances at all conditions achieved.

Design trade-offs may be made so as to allow a reasonable clearance at steady-state without having unacceptably limited operability. Materials and geometry may be selected between the static components 22 and the rotating components 24 so as to arrive at a match that is as close as possible to optimum. Preferably, the optimum application of induction heating is an application that permits the clearance to remain substantially the same throughout the operation of the gas turbine engine 100, i.e. both during steady-state and during transient conditions. Preferably any thermal expansion exhibited by the static components 22 and the rotating components 24 will enable them to grow in unison.

Figure 3:
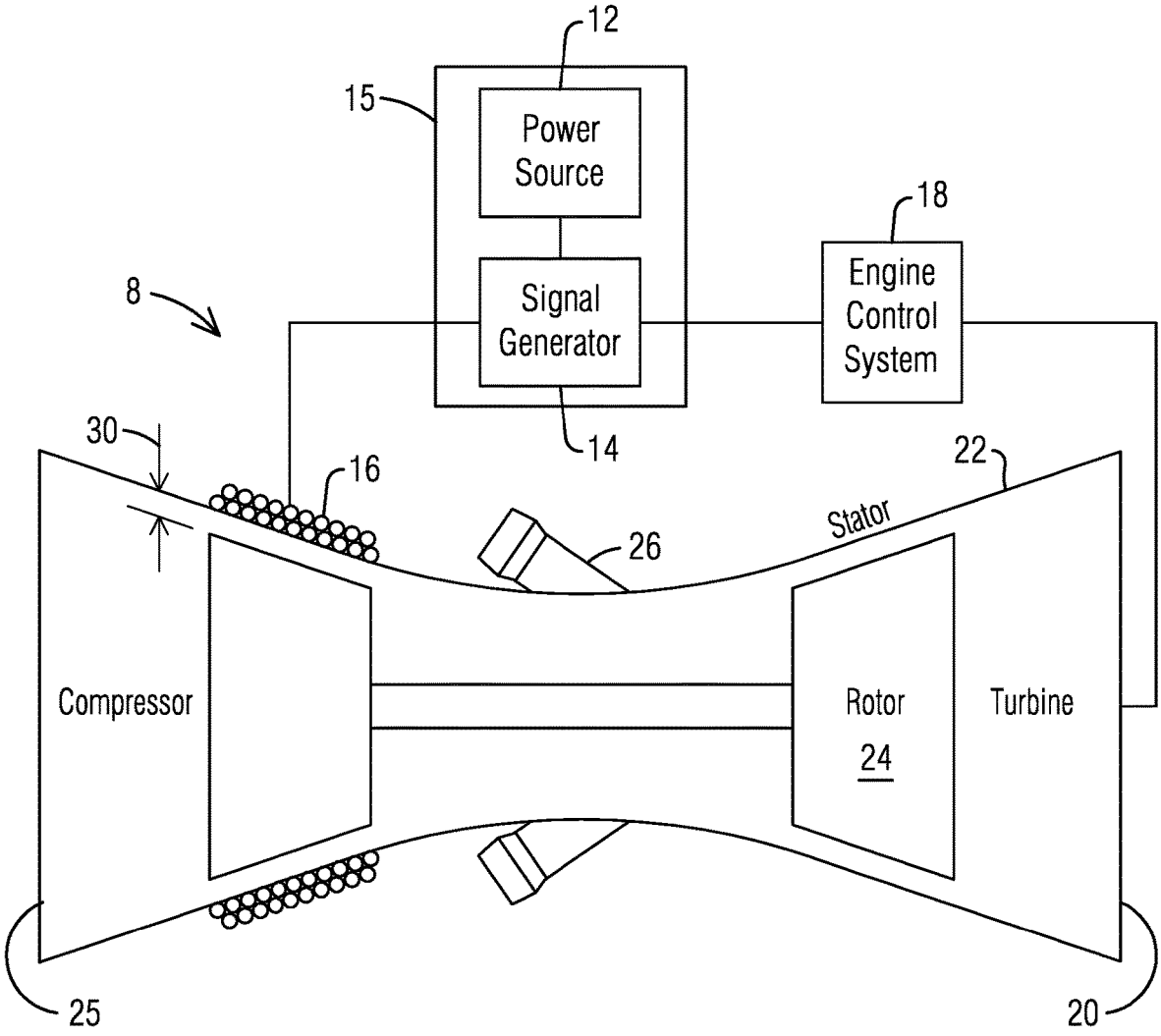
FIG. 3 is a diagram illustrating the system for implementation of induction heating during operation of the gas turbine engine.

Referring now to FIG. 3, a gas turbine engine induction system 10 is shown that provides the induction heating of gas turbine engine components. Induction heating is the process of heating an electrically conducting component by electromagnetic induction, via heat generated within the object by eddy currents.

The gas turbine engine induction system 10 is installed on a gas turbine engine 100. The gas turbine engine 100 has a turbine 20 that comprises a static component 22 and a rotating component 24. The static component 22 may be a stator while the rotating component 24 may be a rotor. While the stators and rotors are discussed in the example provided herein. Other examples where this may be applicable within the gas turbine engine 100 may be for casings.

The gas turbine engine 100 also comprises a compressor 25, combustor 26 and an engine control system 18.

The gas turbine engine induction system 10 employs an induction heater 8. An induction heater 8 generally comprises components that operate as an electromagnet that has an electronic oscillator that passes a high-frequency alternating current (AC) through the electromagnet. The rapidly alternating magnetic field penetrates the component to be heated thereby generating electric currents inside the component called eddy currents. The eddy currents flowing through the resistance of the material heat it by Joule heating. In ferromagnetic materials like iron, heat may also be generated by magnetic hysteresis losses. A feature of the induction heating process is that the heat is generated inside the object itself, instead of by an external heat source via heat conduction. Thus components can be heated very rapidly. Additionally there does not need to be any additional external contact via a heating component.

In FIG. 3, the induction heater 8 comprises an induction coil 16 and an electric component 15. The electric component 15 comprises a power source 12 and signal generator 14. The power source 12 and the signal generator 14 provide electric current to the induction coil 16. The provision of the electric current to the induction coil 16 will generate heat within electrically conductive target component, in this instance static component 16.

Still referring to FIG. 3, the induction coil 16 is placed around the static component 22. The induction coil 16 may vary in terms of spacing between each loop of the coil and the number of coil. This variation impacts the manner and rate in which the static component 22 is heated. The induction coil 16 may be made of fibre glass casing, internal wires of stainless steel and copper.

Applying induction heating via the induction heater 8 to static components 22 is a way to quickly heat the static components 22 to a temperature that would offer a benefit for start time and/or transient flexibility. This requires an induction coil 16 appropriately sized and wrapped around the static component 22 with appropriate spacing for the induction coil 16. The correct current and voltage are then set to deliver the desired electromagnetic induction to achieve the required temperature for the static component 22. A similar solution could be applied to steam turbines The control of current to the induction coil 16 can be harmonized with the engine control system 18 to minimize response time. In other words, the engine control system 18 can be connected to the electric component 15 in order to provide signals via the signal generator 14 that indicate that the electric signals should be transmitted so as to correspond with the transient conditions of the gas turbine engine 100.

The provision of signals via the signal generator 14 during the appropriate times ensures that the target static component 22 reaches the desired temperature when the control system 18 detects the need for a transient condition, such as acceleration, the electric component 15 transmits current to the induction coil 18. The induction coil 18 will cause the static component 22 to heat up. Preferably, the heating of the static component 22 can be such that it maintains a clearance 30 that is substantially the same as during the steady-state condition.

The temperature of the static component 22 can be monitored either with proximity measurements between static components 22 and rotating components 24. The proximity measurements can also be obtained via a map that allows control based on inductive coil current set points. Such a map is developed through modelling to correlate the current supplied to the induction coil 18 with the clearance 30 between the static component 22 and the rotating component 24.

Figure 4:
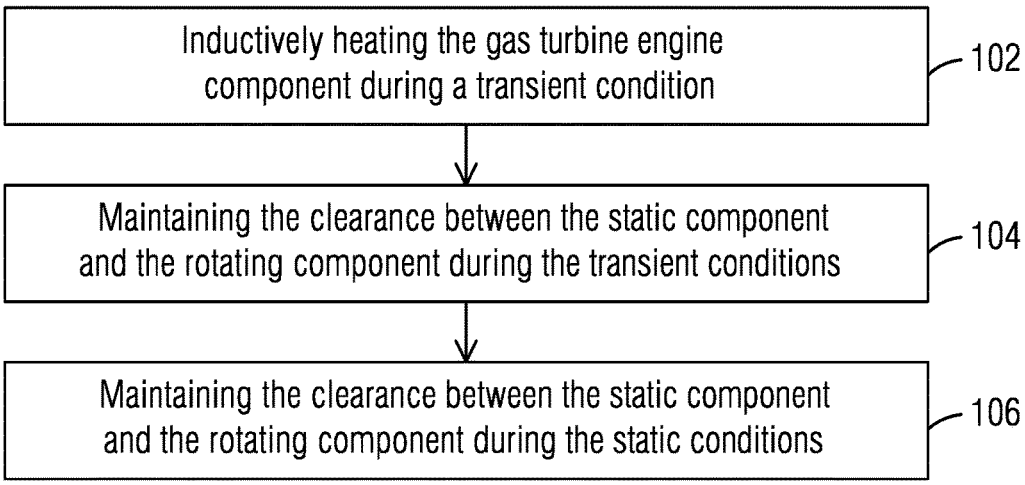
FIG. 4 is a flow chart setting forth the method for implementation of induction heating during operation of the gas turbine engine.

Referring to FIG. 4, the method for inductively heating a static component 22 of a gas turbine engine 100 is shown. In step 102, the static component 22 is inductively heated during a transient state. As discussed above the transient state can be ignition, acceleration, deceleration and cooling. The inductive heating of the static component 22 is to maintain the clearance 30 between the static component 22 and the rotating component 24.

The heating of the static component 22 will cause the materials to expand. Therefore, the induction heating of the static component 22 may begin prior to the initiation of the transient condition in the gas turbine engine 100. For example, the engine control system 18 may receive a signal to implement ignition in the gas turbine engine 100. The engine control system 18 may transmit a signal to the electric component 15 of the induction heater 8. The electric component 15 may then initiate the induction heating. The induction heating of the static component 22 may occur for a period of time prior to the ignition of the gas turbine engine 100 so as to ensure that the clearance 30 is at a preferred distance for the operation of the gas turbine engine 100. As the transient condition occurs through ignition and acceleration, the induction heating of the static component can continue.

In step 104, the clearance 30 between the static component 22 and the rotating component 24 is maintained during the transient conditions. The maintenance of the clearance 30 may be achieved by starting and ceasing the inductive heating of the static component 22. This may occur periodically so as to maintain a substantially uniform clearance 30. By substantially uniform clearance it is meant that the clearance 30 is preferably between 0-5 μm. Preferably, this uniform clearance is maintained through the stages of acceleration, and deceleration.

In step 106, the clearance 30 between the static component 22 and the rotating component 24 is maintained during the steady-state conditions. The maintenance of the clearance 30 may be achieved by starting and ceasing the inductive heating of the static component 22. This may occur periodically so as to maintain a substantially uniform clearance 30. By substantially uniform clearance it is meant that the clearance 30 is preferably between 0-5 μm. Preferably, this uniform clearance is maintained during the steady-state operation of the gas turbine engine 100. It should be understood that prior to start-up and after shut-down the inductive heating of the static component 22 is not needed.

During both steps 104 and 106 the clearance 30 can be determined actively based upon sensor measurements of the distance between the static component 22 and the rotating component 24. The clearance 30 may also be inferred from measurement of the temperatures of the static component 22, the rotating component 24 or both. Based upon the measurements the application of the inductive heating may be started, ceased, or altered in some fashion (i.e. increased or decreased current so as to impact the heating of the static component 22).

Alternatively, the clearance 30 can be determined passively based upon the behaviour of the gas turbine engine 100. The electric component 15 can be programmed in conjunction with the engine control system 18 to perform predetermined application of the induction heating during the operation of the gas turbine engine 100.

Induction heating allows for more flexible operation of the gas turbine engine 100 (e.g. faster start and response times to load change) than other solutions. It may offer lower capital costs than material solutions. Furthermore, it may even potentially lower capital and operating costs rather than using on-engine air for heating or cooling of static components 22.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A gas turbine engine induction system for inductively heating a component of a gas turbine engine comprising:

a gas turbine engine having a longitudinal axis extending lengthwise through the center of the gas turbine engine;

an induction heater located proximate to a static component of the gas turbine engine;

a rotating component located radially inward from the static component, wherein there is a clearance space between the rotating component and the static component; and wherein the induction heater is adapted to heat the static component during a transient condition of the gas turbine engine to maintain a clearance space between the static component and the rotating component, and wherein the induction heater is adapted so as to maintain substantially the same clearance space between the static component and the rotating component during the transient condition and a steady-state condition throughout operation of the gas turbine engine.

2. The system of claim 1, wherein the transient condition comprises a temperature change of the gas turbine engine.

3. The system of claim 1, wherein the steady-state condition comprises a steady temperature of the gas turbine engine.

4. The system of claim 1, wherein the induction heater comprises coils surrounding the static component of the gas turbine engine.

5. The system of claim 4, wherein the induction heater further comprises an electric component for supplying current to the coils.

6. The system of claim 1, wherein the static component of the gas turbine engine is a stator and the rotating component of the gas turbine engine is a blade.

7. An induction heater for a gas turbine engine comprising:

a coil adapted to surround a static component of a gas turbine engine, wherein the gas turbine engine has a longitudinal axis extending lengthwise through the center of the gas turbine engine, wherein a rotating component is located radially inward from the static component, wherein there is a clearance space between the rotating component and the static component; and an electric component for transmitting electricity through the coil surrounding the static component, wherein the electric component is adapted to transmit electricity to the coil to heat the static component to maintain a clearance space between the static component and the rotating component during a transient condition of the gas turbine engine, and wherein the electric component is adapted to maintain substantially the same clearance space between the static component and the rotating component during the transient condition and a steady-state condition throughout operation of the gas turbine engine.

8. The induction heater of claim 7, wherein the transient condition comprises a temperature change of the gas turbine engine.

9. The induction heater of claim 7, wherein the steady-state condition comprises a steady temperature of the gas turbine engine.

10. The induction heater of claim 7, wherein the static component of the gas turbine engine is a stator and the rotating component of the gas turbine engine is a blade.

11. A method for inductively heating a component of a gas turbine engine comprising:

inductively heating a static component to maintain a clearance space between the static component and a rotating component during a transient condition of the gas turbine engine, wherein the gas turbine engine has a longitudinal axis extending lengthwise through the center of the gas turbine engine, wherein the gas turbine engine has a rotating component located radially inward from the static component; and maintaining substantially the same clearance space between the static component and the rotating component during the transient condition and a steady-state condition throughout operation of the gas turbine engine.

12. The method of claim 11, wherein the step of inductively heating is performed by an induction heater located proximate to the static component of the gas turbine engine.

13. The method of claim 11, wherein the transient condition comprises a temperature change of the gas turbine engine.

14. The method of claim 11, wherein the steady-state condition comprises a steady temperature of the gas turbine engine.

15. The method of claim 11, wherein the step of inductively heating occurs using an induction heater comprising coils surrounding the static component of the gas turbine engine.

16. The method of claim 15, wherein the step of inductively heating occurs using the induction heater comprising an electric component for supplying current to the coils.

17. The method of claim 11, wherein the step of maintaining substantially the same clearance space comprises increasing and deceasing inductively heating the static component.

18. The induction heater of claim 7, wherein the electric component is adapted to increase and decrease heating the static component to maintain substantially the same clearance space.

19. The system of claim 1, wherein the induction heater is adapted to increase and decrease heating the static component to maintain substantially the same clearance space.

20. The system of claim 1, wherein the substantially same clearance space is between 0-5 μm.

* * * * *